US006200413B1

(12) United States Patent
Privitt et al.

(10) Patent No.: US 6,200,413 B1
(45) Date of Patent: Mar. 13, 2001

(54) QUADRI-POINT PRECISION SPHERE POLISHER

(75) Inventors: Roger Privitt, Garland; Akira Ishikawa, Royce City, both of TX (US); Takashi Kanatake, Tokorozawa (JP)

(73) Assignee: Ball Semiconductor, Inc., Allen, TX (US)

( * ) Notice: Subject to any disclaimer, the term of this patent is extended or adjusted under 35 U.S.C. 154(b) by 0 days.

(21) Appl. No.: 09/233,257

(22) Filed: Jan. 19, 1999

(51) Int. Cl.[7] ..... B24B 11/02; B24B 9/00; C23F 1/02

(52) U.S. Cl. ..... 156/345; 451/50; 451/163; 451/284; 451/328

(58) Field of Search ..... 156/345; 451/49, 451/50, 11, 12, 112, 163, 180, 284, 328; 51/308

(56) References Cited

U.S. PATENT DOCUMENTS 3,999,330 * 12/1976 Brany ..... 51/130
5,921,851 * 7/1999 Suzuki et al. ..... 451/267

FOREIGN PATENT DOCUMENTS 47-38796 9/1972 (JP) .
47-36198 11/1972 (JP) .
49-96589 8/1974 (JP) .
61-192461 8/1986 (JP) .
61-209873 9/1986 (JP) .
61-270071 11/1986 (JP) .

OTHER PUBLICATIONS

Marcelja et al., Silicon Spheres for Gravity Probe B Experiment, 1998 Spring Topical Meeting, vol. 17, The American Society for Precision Engineering, Apr. 1998, pp. 74–77.

Achim J. Leistner, Fabrication of IKG Single Crystal Silicon Super–Precision Spheres (BALLS) for the Avogadro's Experiment, 1998 Spring Topical Meeting, vol. 17, The American Society for Precision engineering, Apr. 1998, pp. 101–104.

* cited by examiner

*Primary Examiner*—Gregory Mills
*Assistant Examiner*—Alva C Powell
(74) *Attorney, Agent, or Firm*—Haynes and Boone LLP

(57) ABSTRACT

A system and method for polishing spherical shaped devices is disclosed. The system includes a carrier and an enclosure. The carrier has two projections so that when a device is placed between the projections, it contacts the carrier at two contact points. The enclosure matingly engages with the carrier so that it also contacts each device at two contact points. A movement system, such as a motor, provides relative movement between the carrier and the enclosure so that the four contact points polish each device. Also, the relative movement moves each device so that the device's entire outer surface is polished by the apparatus.

28 Claims, 6 Drawing Sheets

QUADRI-POINT PRECISION SPHERE POLISHER

BACKGROUND OF THE INVENTION

The invention relates generally to machining systems, and more particularly, to a system and method for polishing spherical shaped devices with a four-point precision polisher.

Conventional integrated circuits, or "chips," are formed from a flat surface semiconductor wafer substrate. The semiconductor wafer is first manufactured in a semiconductor material manufacturing facility and is then provided to a fabrication facility. At the latter facility, several layers are processed onto the semiconductor wafer surface. Once completed, the wafer is then cut into one or more chips and assembled into packages. Although the processed chip includes several layers fabricated thereon, the chip still remains relatively flat.

Manufacturing the wafer substrate requires creating rod-form polycrystalline semiconductor material; precisely cutting ingots from the semiconductor rods; cleaning and drying the cut ingots; manufacturing a large single crystal from the ingots by melting them in a quartz crucible; grinding, etching, and cleaning the surface of the crystal; cutting, lapping and polishing wafers from the crystal; and heat processing the wafers. Moreover, the wafers produced by the above process typically have many defects. These defects can be attributed to the difficulty in making a single, highly pure crystal due to the cutting, grinding and cleaning processes as well as impurities associated with containers used in forming the crystals. These defects become more and more prevalent as the integrated circuits formed on these wafers contain smaller and smaller dimensions.

In co-pending U.S. Pat. No. 5,955,776 filed on May 16, 1997, herein incorporated by reference, a method and apparatus for manufacturing spherical-shaped semiconductor integrated circuit devices is disclosed. Although certain manufacturing methods for making and polishing spherical shaped substrates are disclosed in the above-referenced application, an improved method of making and polishing the spherical shaped substrates, which includes fewer defects and is more manufacturable, is desired. Furthermore, it is desired for the improved method to be relatively quick, yet still be very precise. Further still, it is desired for the improved method to support pipeline production techniques, instead of batch processing as is commonly used in conventional substrate manufacturing processes.

SUMMARY OF THE INVENTION

The present invention, accordingly, provides an apparatus and method for polishing spherical shaped devices. To this end, one embodiment provides a system including a carrier and an enclosure. The carrier has two projections so that when a device is placed between the projections, it contacts the carrier at two contact points. The enclosure matingly engages with the carrier so that it also contacts each device at two contact points. A movement system, such as a motor, provides relative movement between the carrier and the enclosure so that the four contact points polish each device. Also, the relative movement moves each device so that the device's entire outer surface is polished by the apparatus.

In another embodiment, the system includes a carrier, a half-enclosure and a rotating means. The carrier has two projections so that when a device is placed between the projections, it contacts the carrier at two contact points. The enclosure matingly engages with the carrier so that it also contacts each device at one contact point. The rotating means also matingly engages with the carrier so that it also contacts each device at one contact point. The motor provides relative movement between the carrier, the rotating means, and the enclosure so that the four contact points polish each device. Also, the relative movement, along with the rotating means, move each device so that the device's entire outer surface is polished by the apparatus.

In yet another embodiment, the system includes a carrier and two rotating means. The carrier has two projections so that when a device is placed between the projections, it contacts the carrier at two contact points. Each of the two rotating means also matingly engages with the carrier so that it also contacts each device at one contact point. The motor provides relative movement between the carrier and the two rotating means so that the four contact points polish each device. Also, the relative movement, along with the two rotating means, move each device so that the device's entire outer surface is polished by the apparatus.

The invention as described in the embodiments above provide many advantages over traditional polishing systems. For one, the four contact points support faster polishing. The present invention also supports a constant flow (instead of batches) of devices.

DESCRIPTION OF THE PREFERRED EMBODIMENT

Figure 1A:
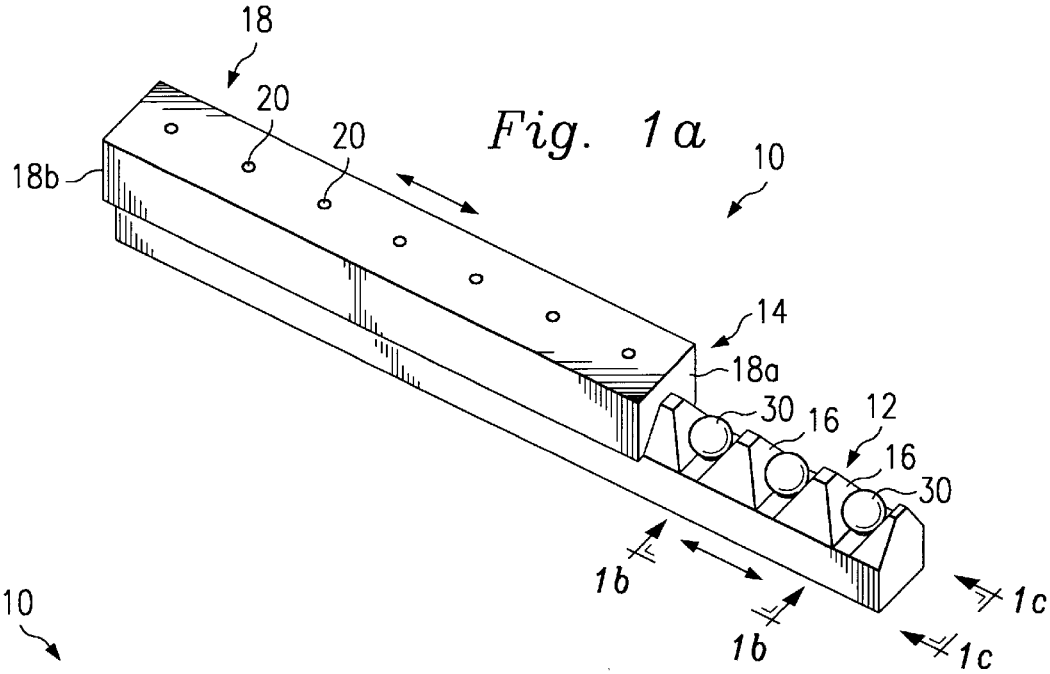
FIG. 1*a* illustrates an isometric view of a processor according to one embodiment of the invention.

Referring to the FIG. 1*a*, the reference numeral 10 designates, in general, one embodiment of a system for polishing spherical shaped devices such as semiconductor crystals. The system 10 includes two main components: a carrier 12 and an enclosure 14. Working together, the carrier 12 and the enclosure 14 serve to polish the devices 12 in a relatively quick manner.

The carrier 12 includes a plurality of evenly spaced, parallel tetrahedral projections 16 extending upwardly from an upper surface 12*a* of the carrier. Each projection 16 has two faces for contacting one of the devices, represented by a front face 16*a* and a back face 16*b*. The projection faces 16*a*, 16*b* are made from a material that facilitates polishing, such as felt pads or crushed diamond. In one embodiment, the projection faces 16*a*, 16*b* use a felt pad similar to those used for conventional wafer polishing, such as described in U.S. Pat. No. 5,542,874 entitled WAFER POLISHING APPARATUS.

The enclosure 14 provides a hollow interior 18 that, when engaged with the carrier 12, fittingly mates with the projections 16. The interior 18 includes an inlet 18*a* and an outlet 18*b*. The hollow interior 18 is also made from a material that facilitates polishing, such as is describe above with respect to the projections 16. The enclosure 14 also includes a plurality of apertures 20 that are open to the hollow interior 18. The apertures 20 serve as inputs for slurry, coolant, and other material that can be used during the polishing process.

Figure 1B:
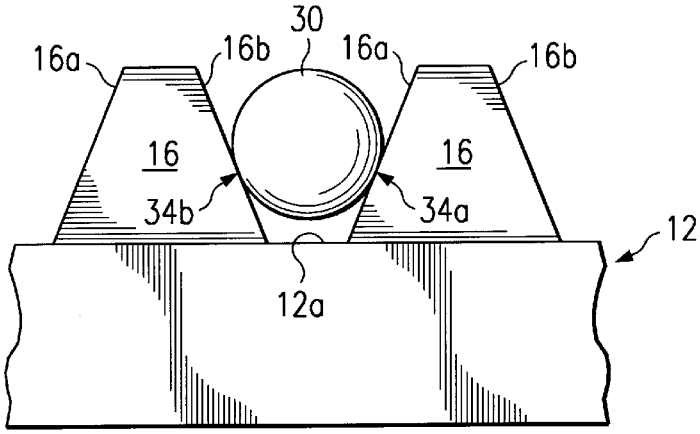
FIGS. 1*b* and 1*c* illustrate side, cut-away views of the processor of FIG. 1*a*.

Referring also to FIG. 1*b*, one or more devices 30 can be positioned between the projection faces 16*a*, 16*b* in the carrier 12. The device 30 is relatively large, as compared to the projections 16 and the projections are spaced at a distance 32 so that each device 30 is supported by the projection faces 16*a*, 16*b* at two distinct contact points 34*a*, 34*b*, respectively.

Figure 1C:
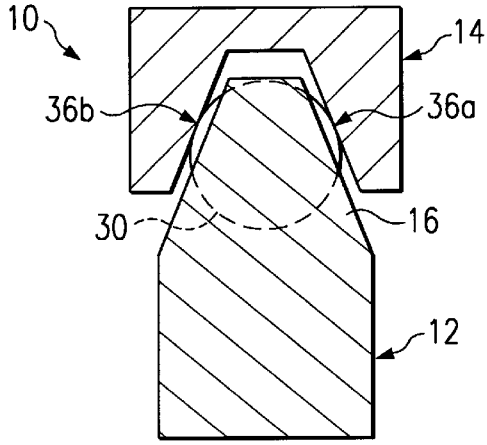

Referring also to FIG. 1*c*, the device 30 also extends from the projection 16 and the projections are spaced at a sufficient distance from the enclosure 14 so that when the carrier 12 and enclosure are engaged, the device will touch the hollow portion 18 at two distinct contact points 36*a*, 36*b*. As a result, the devices 30 are frictionally fit with the carrier 12 and enclosure 14 at four different contact points 34*a*, 34*b*, 36*a*, 36*b* during engagement.

In operation, relative movement is applied between the carrier 12 and the enclosure 14. In some embodiments, only one of either the carrier 12 or the enclosure 14 is moved and in other embodiments, both are moved. During the relative movement, slurry material is provided to the system 10, such as through the apertures 20, the inlet 18*a* and/or the outlet 18*b*. Each of the four contact points 34*a*, 34*b*, 36*a*, 36*b* polish the devices 30 during the relative movement, thereby making each device a sphere of uniform shape and size. Also, the relative movement moves each device 30 so that its entire outer surface is polished.

Figure 2:
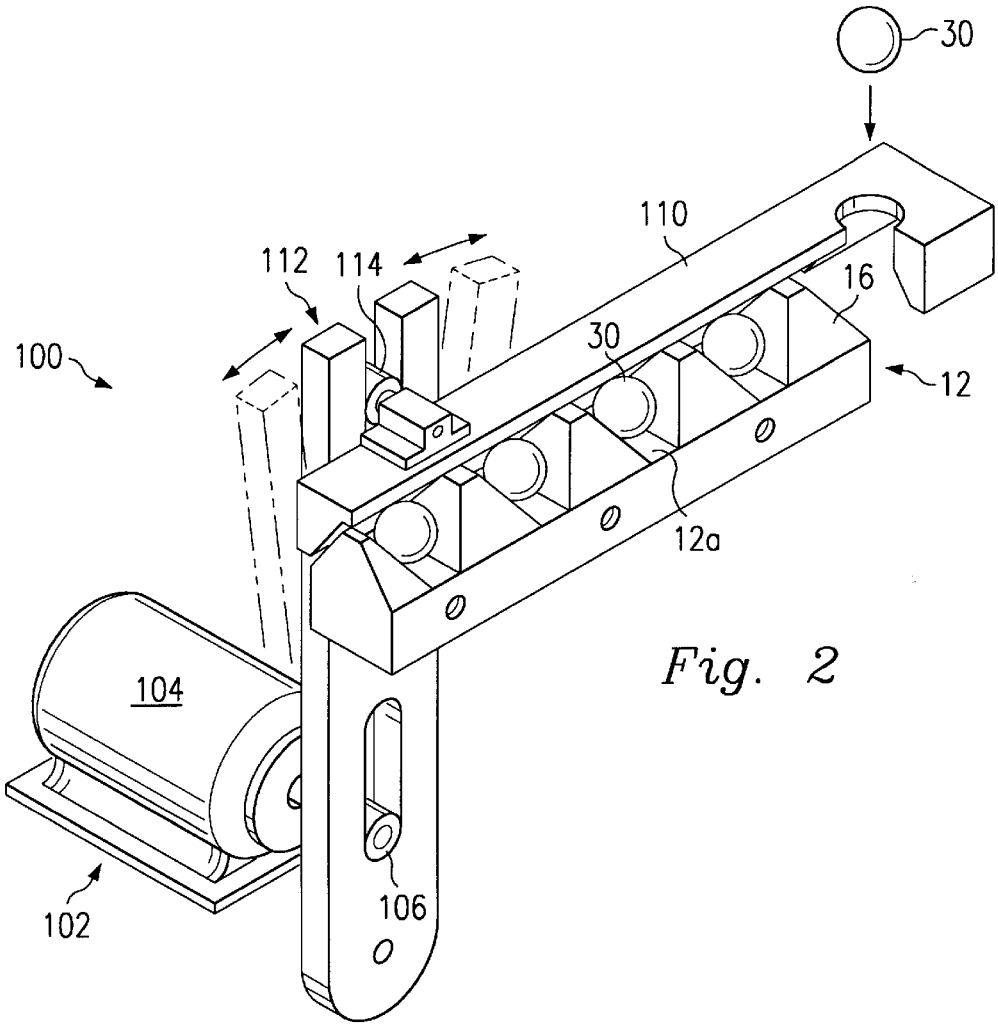
FIGS. 2–7 illustrate isometric views of processors according to other embodiments of the invention.

Referring to FIG. 2, another embodiment of a system for polishing spherical shaped devices such as semiconductor crystals is designated with reference numeral 100. The system 100 includes the carrier 12, as described above with reference to FIG. 1*a*, and the plurality of evenly spaced, parallel tetrahedral projections 16 extending upwardly from an upper surface 12*a* of the carrier. In the present embodiment, however, the carrier 12 does not move.

The system 100 utilizes a drive mechanism 102 which includes a motor 104. The motor 104 rotates a ball bearing 106 in a circular motion to generate a lateral, polishing movement for the system 100.

The system 100 also includes an enclosure 110, which is similar but not identical to the enclosure 14 of FIG. 1*a*. The enclosure 110 is connected to the drive mechanism 102 through a transfer bar 112 so that the enclosure can move laterally, with respect to the carrier 12. The connection to the transfer bar 112 is facilitated by a ball bearing 114 that is restricted to lateral movement, with respect to the carrier 12. Although the enclosure 110 does not contain the slurry apertures 20 provided in the embodiment of FIG. 1*a*, it does contain a product inlet aperture 114 for receiving and/or removing each device 30 in a serial manner.

In operation, the system 100 behaves similarly to the system 10 of FIG. 1*a*. The motor 104 turns the ball bearing 106 in a circular motion, thereby moving the transfer bar 112 and providing relative movement between the carrier 12 and the enclosure 110. Each of the four contact points 34*a*, 34*b*, 36*a*, 36*b* polish the devices 30 during the relative movement, thereby making each device a sphere of uniform shape and size. Also, the relative movement moves each device 30 so that its entire outer surface is polished.

Figure 3:
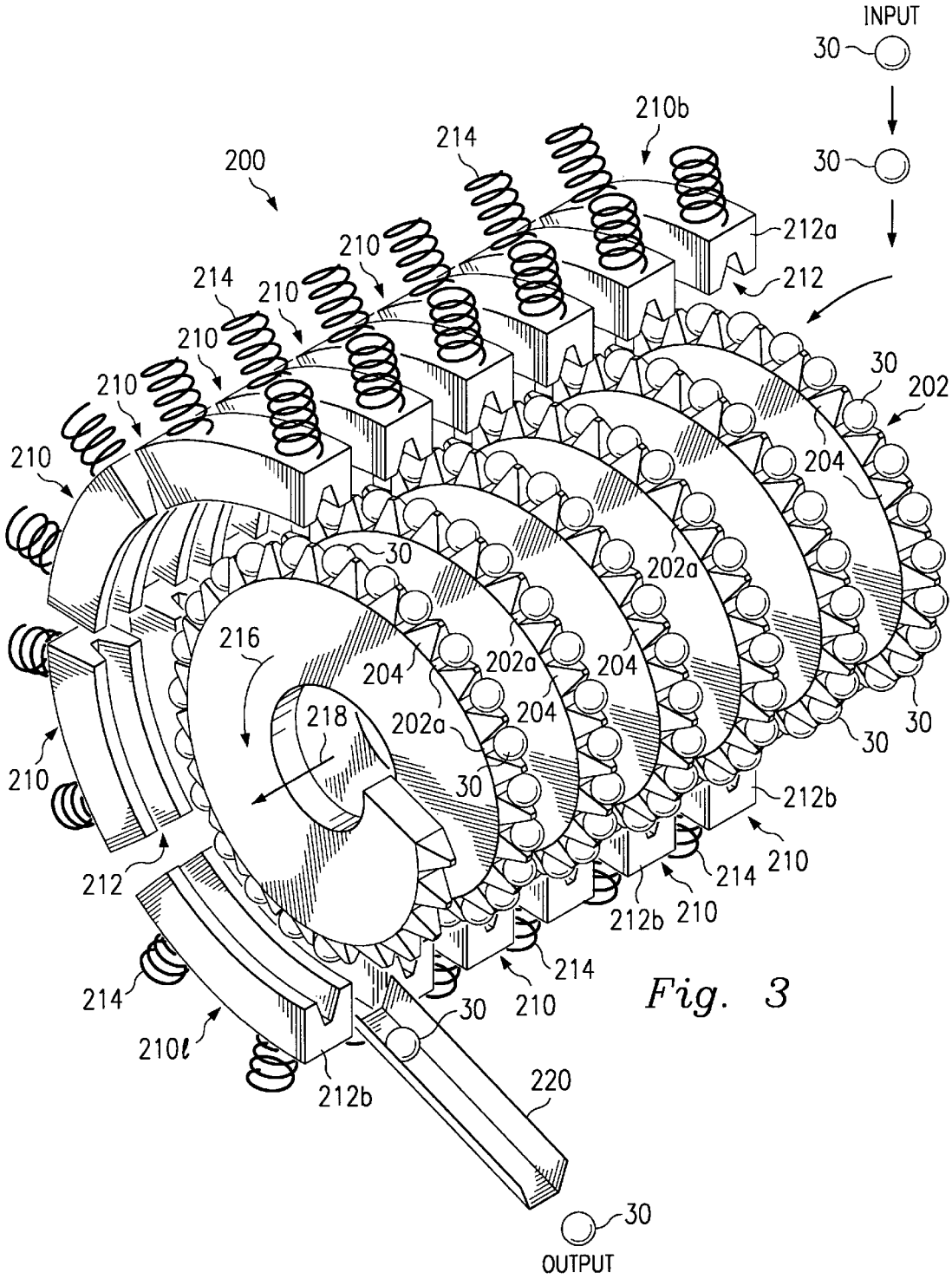

Referring to FIG. 3, another embodiment of a system for polishing spherical shaped devices such as semiconductor crystals is designated with reference numeral 200. The system 200 includes a spiral-shaped ring carrier 202 with a plurality of evenly spaced, parallel tetrahedral projections 204 extending upwardly from an upper surface 202*a* of the carrier.

The system 200 also includes a spiral-shaped enclosure 210. Although illustrated as being several discrete sub-components, the enclosure 210 may alternatively be a single spiral-shaped unit. The enclosure 210 provides a hollow interior 212 that, when engaged with the spiral-shaped ring carrier 202, fittingly mates with the projections 204. The interior 212 of each sub-component includes an inlet 212*a* and an outlet 212*b*. The hollow interior 212 is also made from a material that facilitates polishing, such as is describe above with respect to the projections 16 of FIG. 1*a*. Each sub-component of the spiral-shaped enclosure 210, or alternatively the entire spiral-shaped unit is attached to one or more compression springs 214. The springs 214 serve to supply additional pressure on the enclosure 210 towards the spiral-shaped carrier 202, thereby facilitating a frictional fit with the devices being polished.

In operation, a motor (not shown) rotates the spiral-shaped carrier 202 in a counter-clockwise direction, represented by arrow 216, which results in a forward direction, represented by arrow 218. The spiral-shaped enclosure 210 is stationary. It is understood, however, that only the relative movement between the carrier 202 and enclosure 210 are needed, and that other types of movement may be applied to either the carrier, the enclosure, or both.

Devices 30 are placed into the carrier 202 at a location near the input 210*a* of a first component 210*f* of the enclosure. As the carrier 202 turns, each device 30 moves along inside of the enclosure 210 and against the different components of the enclosure 210. As the devices 30 move, four contact points (two from the projections 204, two from the enclosure 210) polish the devices, thereby making each device a sphere of uniform shape and size. Also, the relative movement moves each device 30 so that its entire outer surface is polished. Although not shown, each of the contact points may include polishing pads as discussed above with reference to FIG. 1*a*. Eventually, each device 30 reaches a last component 210*l* of the enclosure 210 and exits the system 200 through an exit chute 220.

Figure 4A:
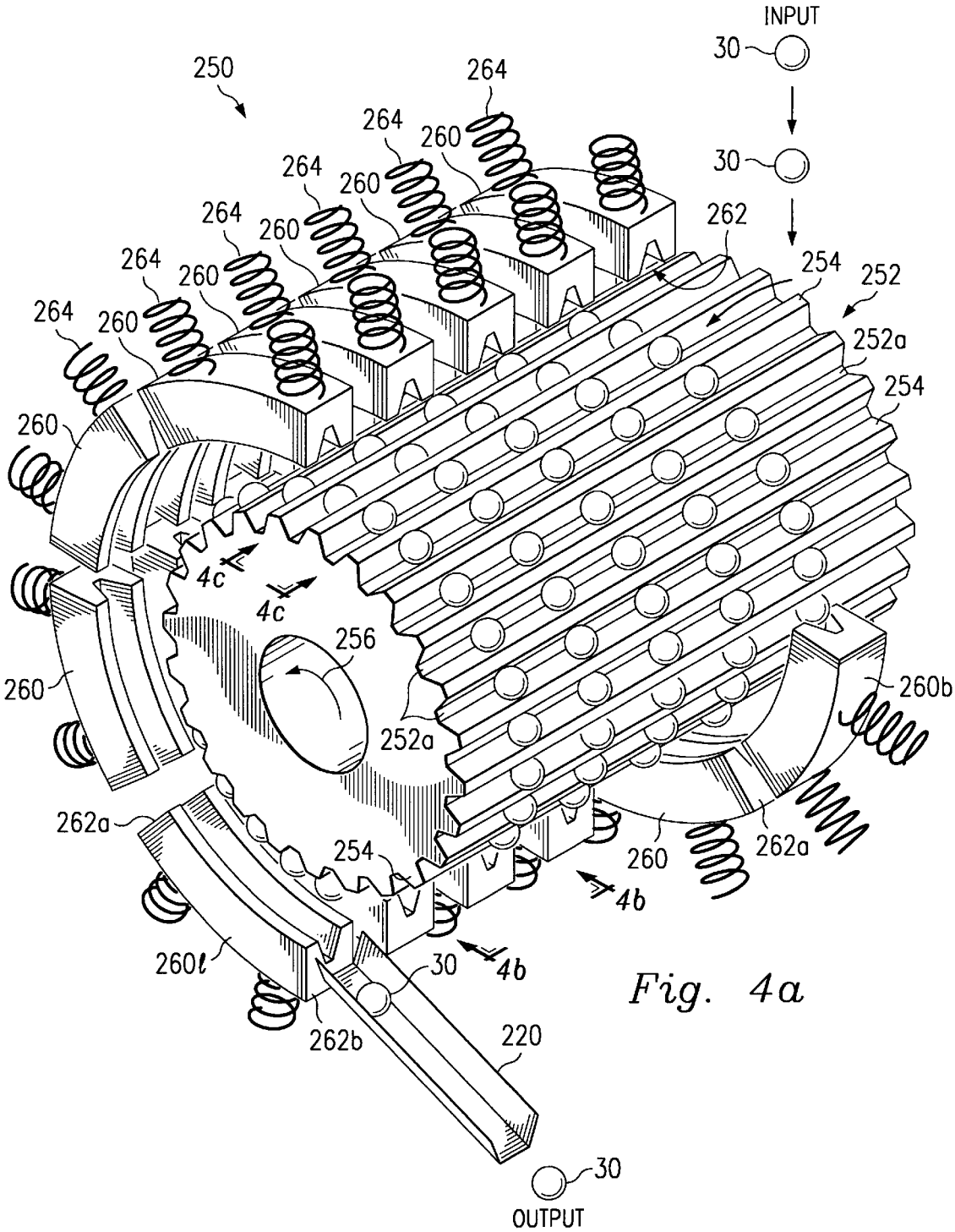

Referring to FIG. 4*a*, yet another embodiment of a system for polishing spherical shaped devices such as semiconductor crystals is designated with reference numeral 250. The system 250 includes a gear-shaped carrier 252 with a plurality of evenly spaced, parallel tetrahedral elongated projections 254 extending upwardly from an upper surface 252*a* of the carrier.

The system 250 also includes a spiral-shaped enclosure 260. The spiral-shaped enclosure 260 is similar to the spiral-shaped enclosure 210 of FIG. 3, with several differences. The enclosure 260 provides a hollow interior 262 that, when engaged with the spiral-shaped ring carrier 252, fittingly mates with the projections 254. The interior 262 of each sub-component includes an inlet 262*a* and an outlet 262*b*. The hollow interior 262 is also made from a material that facilitates polishing, such as is describe above with respect to the projections 16 of FIG. 1*a*. Each sub-component of the spiral-shaped enclosure 260, or alternatively the entire spiral-shaped unit is attached to one or more compression springs 264. The springs 214 serve to supply additional pressure on the enclosure 260 towards the spiral-shaped carrier 252, thereby facilitating a frictional fit with the devices being polished.

Figure 4B:
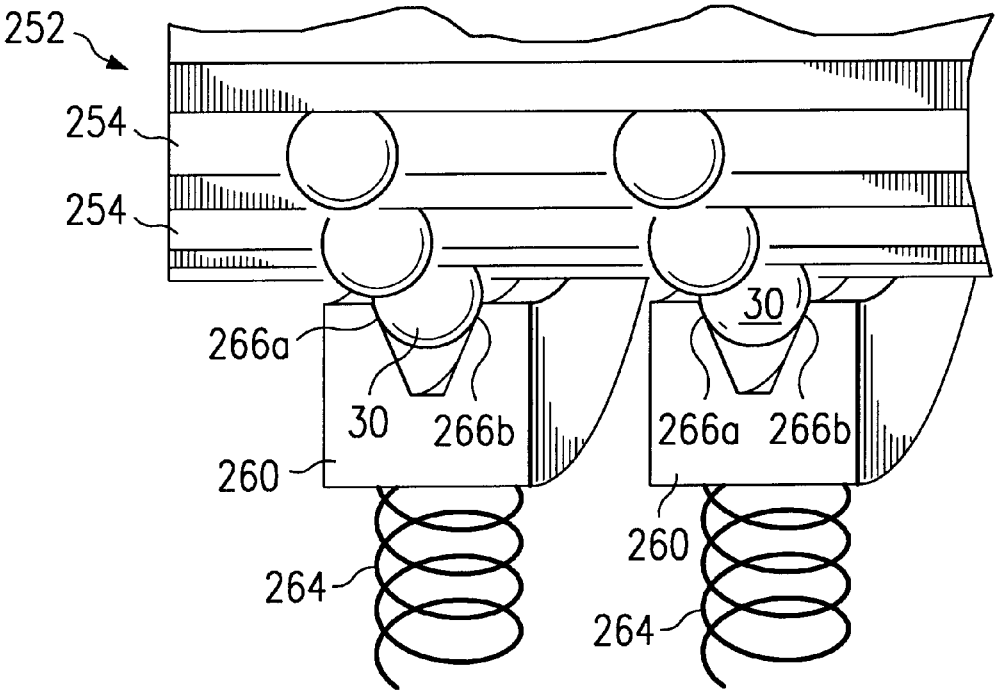

Referring also to FIG. 4*b*, the device 30 extends from the projections 254 and the projections are spaced at a sufficient distance from the enclosure 260 so that when the carrier 252 and enclosure are engaged, the device will touch the hollow portion 262 at two distinct contact points 266*a*, 266*b*.

Figure 4C:
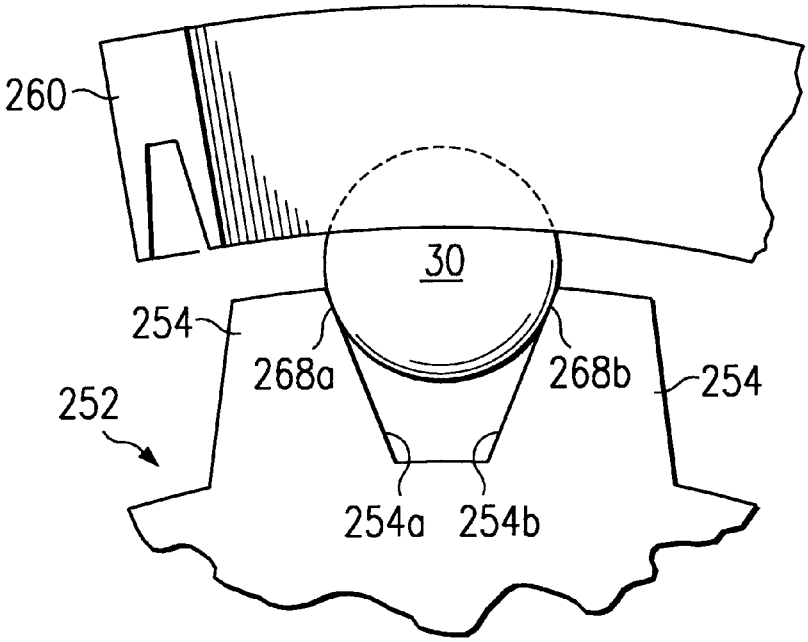

Referring also to FIG. 4*c*, the device 30 is also positioned between two projection faces 254*a*, 254*b* in the carrier 252. The device 30 is relatively large, as compared to the projections 16 and the projections are spaced at a distance so that each device 30 is supported by the projection faces 254*a*, 254*b* at two distinct contact points 268*a*, 268*b*, respectively. As a result, the devices 30 are frictionally fit with the carrier 12 and enclosure 14 at four different contact points 266*a*, 266*b*, 268*a*, 268*b* during engagement.

In operation, a motor (not shown) rotates the gear-shaped carrier 252 in a counter-clockwise direction, represented by arrow 256. The spiral-shaped enclosure 260 is stationary. It is understood, however, that only the relative movement between the carrier 252 and enclosure 260 are needed, and that other types of movement may be applied to either the carrier, the enclosure, or both.

Devices 30 are placed into the carrier 252 at a location near the input 260*a* of the first component 260*f* of the enclosure. As the carrier 252 turns, each device 30 moves along inside of the enclosure 260 and against the different components of the enclosure 260. As the devices 30 move, four contact points (two from the projections 254, two from the enclosure 260) polish the devices, thereby making each device a sphere of uniform shape and size. Also, the relative movement moves each device 30 so that its entire outer surface is polished. Although not shown, each of the contact points may include polishing pads as discussed above with reference to FIG. 1*a*. Eventually, each device 30 reaches a last component 260*l* of the enclosure 210 and exits the system 250 through the exit chute 220.

Figure 5:
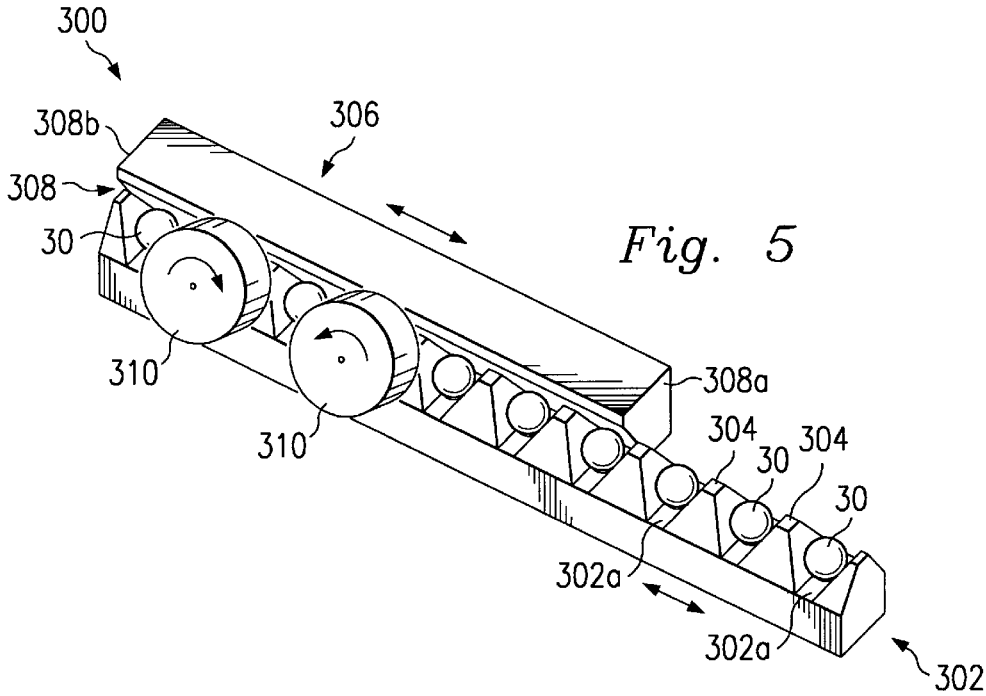

Referring to FIG. 5, yet another embodiment of a system for polishing spherical shaped devices such as semiconductor crystals is designated with reference numeral 300. The system 300 includes an elongated carrier 302 with a plurality of evenly spaced, parallel tetrahedral projections 304 extending upwardly from an upper surface 302*a* of the carrier. The carrier 302 is very similar to the carrier 12 of FIG. 1 and provides two contact points on each device 30.

The system 300 also includes a half-enclosure 306. The half-enclosure 306 provides a hollow interior 308 that, when engaged with the carrier 300, fittingly mates with the projections 16 and provides a single contact point with each device 30. The interior 308 includes an inlet 308*a* and an outlet 308*b*. The hollow interior 308 is also made from a material that facilitates polishing, such as is describe above with respect to the enclosure 14 of FIG. 1. Although not shown, the half-enclosure 306 may also include a plurality of apertures that are open to the hollow interior 308. The apertures serve as inputs for slurry, coolant, and other material that can be used during the polishing process.

The system 300 also includes one or more polishing disks 310. The polishing disks 310 use a felt pad similar to those used for conventional wafer polishing, such as is described with reference to projection faces 16*a*, 16*b* of FIG. 1 and provide a single contact point with each device 30. Although not shown, the polishing disks 310 may also utilize a reservoir to receive slurry, coolant, and/or other material that can be used during the polishing process.

In operation, a motor (not shown) moves either or both of the carrier 302 and the enclosure 306, providing relative movement therebetween. The disks 310 are also rotated, either in synchronism or at different speeds/directions. In some embodiments, each device 30 is randomly rotated by the different movements of the carrier 302, the enclosure 306 and/or the disks 310.

During the above-described movement, slurry material is provided to the system 300, such as through apertures in the enclosure 306 or from the disks 310. Each of the four contact points described above polish the devices 30 during the relative movement, thereby making each device a sphere of uniform shape and size.

Figure 6:
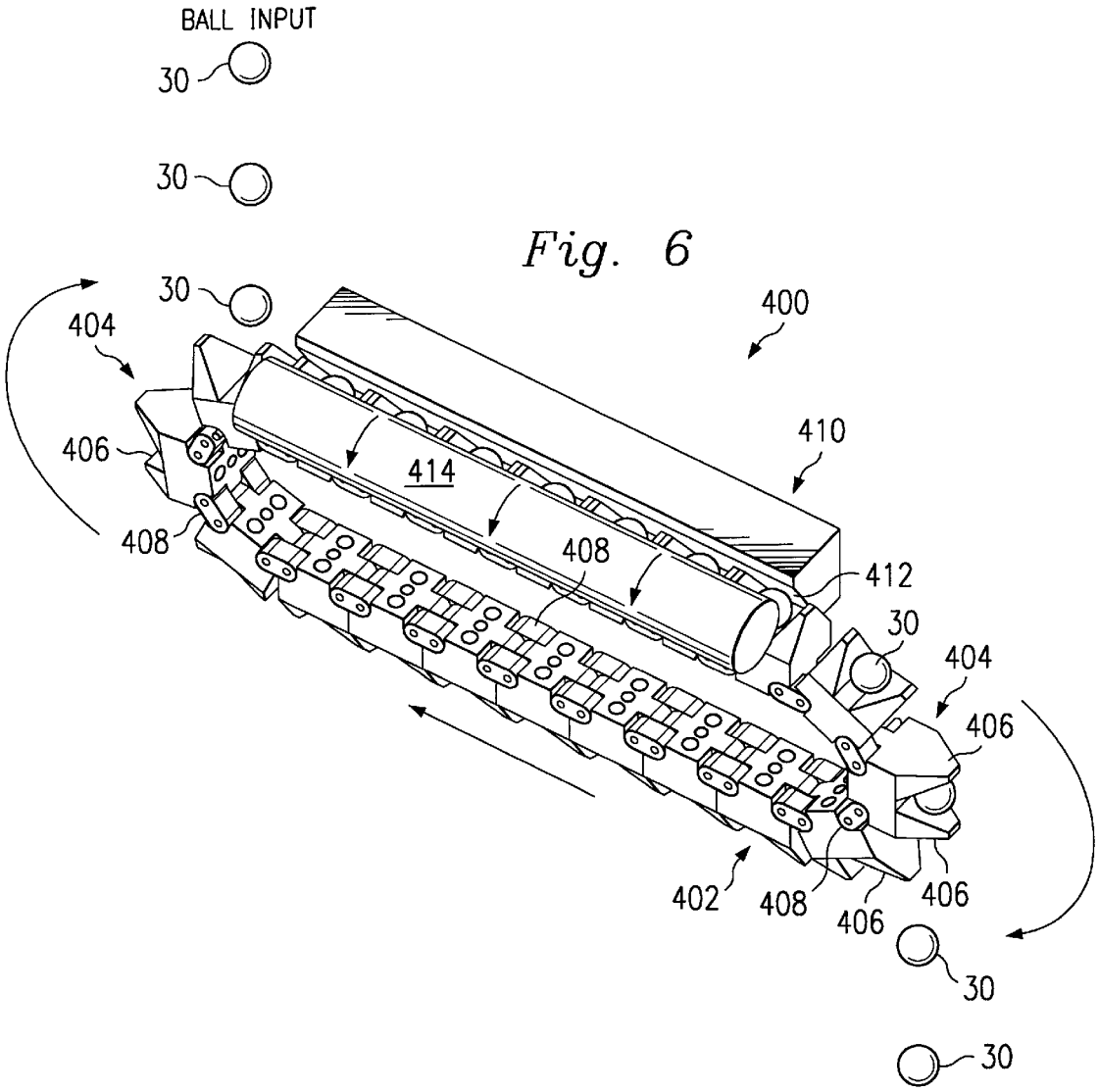

Referring to FIG. 6, yet another embodiment of a system for polishing spherical shaped devices such as semiconductor crystals is designated with reference numeral 400. The system 400 includes a linked carrier system 402 with a plurality of evenly spaced, carrier links 404. Each carrier link 404 includes two parallel tetrahedral projections 406 extending upwardly from an upper surface 404*a* of the carrier link. Each carrier link 404 also includes a flexible connection 408 for interconnecting the links to form the linked carrier system 402.

The system 400 also includes a half-enclosure 410. The half-enclosure 410 is similar to the half-enclosure 306 of FIG. 5. The enclosure 410 provides a hollow interior 412 that, when engaged with the carrier system 402, fittingly mates with the projections 406 and provides a single contact point with each device 30.

The system 400 also includes a rotating polishing rod 414. The polishing rod 414 uses a felt pad, such as is described with reference to projection faces 16*a*, 16*b* of FIG. 1, and provides a single contact point with each device 30. Although not shown, the polishing rod 414 may also utilize a reservoir to receive slurry, coolant, and/or other material that can be used during the polishing process.

In operation, a motor (not shown) moves any combination of the carrier system 402, the enclosure 410, and the polishing rod 414, providing relative movement therebetween. Another motor (also not shown) rotates the polishing rod 414 to provide additional polishing movement. In addition, slurry material may be provided to the system 400, such as from the enclosure 410, polishing rod 414, or carrier system 402. As a result, each of the four contact points described above polish the devices 30 during the relative and rotational movement. Also, the relative movement moves each device 30 so that its entire outer surface is polished, thereby making each device a sphere of uniform shape and size.

Figure 7:
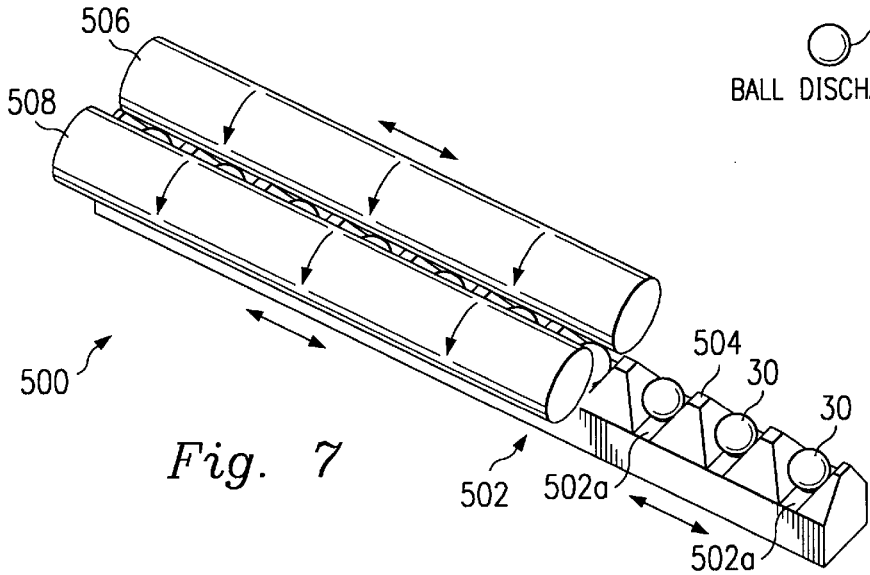

Referring to FIG. 7, yet another embodiment of a system for polishing spherical shaped devices such as semiconductor crystals is designated with reference numeral 500. The system 500 includes an elongated carrier 502 with a plurality of evenly spaced, parallel tetrahedral projections 504 extending upwardly from an upper surface 502*a* of the carrier. The carrier 502 is very similar to the carrier 12 of FIG. 1 and provides two contact points on each device 30.

The system 500 also includes two rotating polishing rods 506, 508. The polishing rods 506, 508 use felt pads, such as is described with reference to projection faces 16*a*, 16*b* of FIG. 1, and provide two contact points with each device 30, one contact point per polishing rod. Although not shown, the polishing rods 506, 508 may also utilize one or more reservoirs to receive slurry, coolant, and/or other material that can be used during the polishing process.

In operation, a motor (not shown) moves any combination of the carrier 502 and the polishing rods 506, 508, providing relative movement therebetween. Two other motors (also not shown) rotate each of the polishing rods 506, 508 to provide additional polishing movement. The polishing rods 506, 508 rotate either in synchronism, or at different speeds/directions. In addition, slurry material may be provided to the system 500, such as from the polishing rods 506, 508 or carrier 502. As a result, each of the four contact points described above polish the devices 30 during the relative and rotational movement, thereby making each device a sphere of uniform shape and size.

It is understood that several variations may be made in the foregoing. For example, different methods for providing movement or slurry material may be applied. Other modifications, changes and substitutions are intended in the foregoing disclosure and in some instances some features of the invention will be employed without a corresponding use of other features. For example, the conveyor-type carrier of FIG. 6 can be used with the embodiment of FIG. 7. Accordingly, it is appropriate that the appended claims be construed broadly and in a manner consistent with the scope of the invention.

What is claimed is:

1. An apparatus for polishing spherical shaped devices, comprising:

a carrier including a plurality of projections such that when a device is placed between two of the projections, it contacts the carrier at a first set of two contact points;

an enclosure for engaging with the carrier so that when a device is placed between the projections, it contacts the enclosure at a second set of two contact points wherein the first set of contact points are in a different plane than the second set of contact points; and means for providing relative movement between the carrier and the enclosure;

wherein the four contact points serve to polish each device placed between the projections, and wherein the relative movement moves each device so that the device's entire outer surface is polished by the apparatus.

2. The apparatus of claim 1 further comprising:

means for providing slurry near the contact points to facilitate polishing.

3. The apparatus of claim 1 wherein the projections are tetrahedral in shape.

4. The apparatus of claim 1 wherein the means for providing relative movement is a motor pivotably attached to the enclosure.

5. The apparatus of claim 1 wherein the enclosure includes an aperture for serially receiving the devices.

6. The apparatus of claim 1 wherein the carrier is spiral-shaped.

7. The apparatus of claim 6 wherein the enclosure is spiral shaped.

8. The apparatus of claim 7 wherein the enclosure includes a plurality of discrete sub-enclosures.

9. The apparatus of claim 8 wherein each of the sub-enclosures are forcibly engaged towards the spiral-shaped carrier.

10. The apparatus of claim 1 wherein the carrier is gear-shaped.

11. The apparatus of claim 10 wherein the enclosure is spiral shaped.

12. The apparatus of claim 11 wherein the enclosure includes a plurality of discrete sub-enclosures.

13. The apparatus of claim 12 wherein each of the sub-enclosures are forcibly engaged towards the gear-shaped carrier.

14. The apparatus of claim 1 wherein the carrier includes flexible connections to facilitate a belt configuration for the carrier.

15. The apparatus of claim 1 wherein the enclosure matingly engages the carrier.

16. An apparatus for polishing spherical shaped devices, comprising:

a carrier including two projections so that when a device is placed between the projections, it contacts the carrier at a first contact point and a second point;

an enclosure for engaging with the carrier so that when a device is placed between the projections, it contacts the enclosure at a third contact point;

rotating means for engaging with the carrier so that when a device is placed between the projections, it contacts the rotating means at a fourth contact point; and means for providing relative movement between the carrier, the rotating means, and the enclosure;

wherein the first and second contacts points are in a different plane than the third and fourth contact points, and the four contact points serve to polish each device placed between the projections, and wherein the relative movement, along with the rotating means, move each device so that the device's entire outer surface is polished by the apparatus.

17. The apparatus of claim 16 further comprising:

means for providing slurry near the contact points to facilitate polishing.

18. The apparatus of claim 16 wherein the projections are tetrahedral in shape.

19. The apparatus of claim 16 wherein the rotating means includes at least one polishing disk.

20. The apparatus of claim 16 wherein the rotating means includes at least one polishing rod.

21. The apparatus of claim 16 wherein the carrier includes flexible connections to facilitate a belt configuration for the carrier.

22. An apparatus for polishing spherical shaped devices, comprising:

a carrier including a plurality of projections so that when a device is placed between two of the projections, it contacts the carrier at a first contact point and a second contact point;

a first rotating means for engaging with the carrier so that when a device is placed between the projections, it contacts the first rotating means at a third contact point;

a second rotating means for engaging with the carrier so that when a device is placed between the projections, it contacts the second rotating means at a fourth contact point; and means for providing relative movement between the carrier and the two rotating means;

wherein the first and second contact points are in a different plane than the third and fourth contact points, and the four contact points serve to polish each device placed between the projections, and wherein the relative movement, along with the two rotating means, move each device so that the device's entire outer surface is polished by the apparatus.

23. The apparatus of claim 22 further comprising:

means for providing slurry near the contact points to facilitate polishing.

24. The apparatus of claim 22 wherein the projections are tetrahedral in shape.

25. The apparatus of claim 22 wherein at least one of the rotating means includes at least one polishing disk.

26. The apparatus of claim 22 wherein at least one of the rotating means includes at least one polishing rod.

27. The apparatus of claim 22 wherein the carrier includes flexible connections to facilitate a belt configuration for the carrier.

28. The apparatus of claim 22 wherein the spherical shaped devices are semiconductor crystals.

* * * * *